US010646008B2

(12) United States Patent
Fisher-Arthur et al.

(10) Patent No.: US 10,646,008 B2
(45) Date of Patent: May 12, 2020

(54) SYSTEM AND METHOD FOR SUPPORTING AN EARRING IN A GAUGED EAR

(71) Applicants: Theresa Marie Fisher-Arthur, New Sharon, IA (US); Vince Wallerich, New Sharon, IA (US)

(72) Inventors: Theresa Marie Fisher-Arthur, New Sharon, IA (US); Vince Wallerich, New Sharon, IA (US)

( * ) Notice: Subject to any disclaimer, the term of this patent is extended or adjusted under 35 U.S.C. 154(b) by 0 days.

(21) Appl. No.: 16/103,752

(22) Filed: Aug. 14, 2018

(65) Prior Publication Data

US 2019/0045889 A1 Feb. 14, 2019

Related U.S. Application Data

(60) Provisional application No. 62/605,433, filed on Aug. 14, 2017.

(51) Int. Cl.
*A44C 7/00* (2006.01)

(52) U.S. Cl.
CPC ..... *A44C 7/003* (2013.01)

(58) Field of Classification Search
CPC ..... A44C 7/003; A44C 7/00; A44C 7/002; A44C 15/0035; A44C 15/0045
USPC ..... 63/12, 13, 40
See application file for complete search history.

(56) References Cited

U.S. PATENT DOCUMENTS 5,018,365 A * 5/1991 Luceno ..... A44C 7/003 24/705
2015/0201719 A1* 7/2015 Seely ..... A44C 7/002 63/13

* cited by examiner

*Primary Examiner* — Jack W Lavinder
(74) *Attorney, Agent, or Firm* — Brett J. Trout

(57) ABSTRACT

A system for retaining an earring with in a gauge hole of an ear. The system is configured with a sleeve defining a resilient passageway. A post of a pierced earring is releasably secured within the resilient passageway and the sleeve is releasably secured with in the gauge hole of an ear. The system may be used to allow prior art ear gauges to retain pierced earrings within a gauge hole of an ear.

13 Claims, 4 Drawing Sheets

SYSTEM AND METHOD FOR SUPPORTING AN EARRING IN A GAUGED EAR

TECHNICAL FIELD

The disclosed embodiments relate generally to a system and method for supporting an earring in a gauged ear, and, in particular, to an ear gauge provided with a pierced earring retainer to allow a user to wear a pierced earring in the gauge.

BACKGROUND

Ear piercing dates back thousands of years. More recently, earrings designed to secure to pierced ears have become somewhat standardized. Modern pierced earrings typically include an ornamental piece secured to a rigid post that fits through a small (typically 18-20 gauge) hole in the user's ear. The post is received by a clutch provided on the opposite side of the ear. To prevent the earring from becoming inadvertently dislodged from the ear, the post is provided with a detent that is received and retained by the clutch. The detent may be a circular groove cut into the post, threading provided in the post, or any type of detent.

While pierced earrings remain popular, newer types of ear ornamentation have been increasing in popularity. One of these types of ornamentation is "gauges." Gauges are a type of ear ornamentation that fits into a larger (typically 14 gauge or larger) hole, in the user's ear. A gauge may be solid "plug," a hollow "tunnel," or any type of ornamentation designed to fit through, and be retained within, the larger hole.

One drawback associated with gauges is that the holes they require are often too large to retain standard pierced earrings. Users who have converted to gauges often have a significant investment in pierced earrings and/or sentimental attachment to pierced earrings gifted to them or handed down from relatives. It would therefore be desirable to provide a way for a user to wear earrings with smaller diameter posts in ears with holes designed for gauges.

SUMMARY OF THE DISCLOSED SUBJECT MATTER

The deficiencies described above are overcome by the disclosed implementation of an earring support system. The earring support system secures an earring with a small diameter post in a larger gauge hole of a gauged ear. The system has an outer sleeve for securement within a gauge hole of a gauged ear and has a resilient interior keeper that fits into engagement with a catch provided on the post of a pierced earring. The earring support system may be worn with or without earrings and accommodates various sizes and types of pierced earrings.

Other implementations of the earring support system are disclosed, including implementations directed to systems for use with prior art gauges.

BRIEF DESCRIPTION OF THE DRAWINGS

The present invention will now be described, by way of example, with reference to the accompanying drawings in which.

DETAILED DESCRIPTION OF THE DRAWINGS

The earring support system of the present invention retains a pierced earring in a gauge hole in the ear of a user. The earring support system described below is distinguished over earlier systems in that the present system securely retains an earring with a small diameter post in a much larger hole. The combination of an outer race engaging the ear of the user with a retention hole allows the system to retain both the ear of a user and the post of the earring. One embodiment of the present system uses a resilient cylindrical body secured within a rigid outer cylinder. The rigid outer cylinder can be flanged or provided with O-rings or similar securement system to prevent inadvertent dislodgement from the ear of a user.

Figure 1:
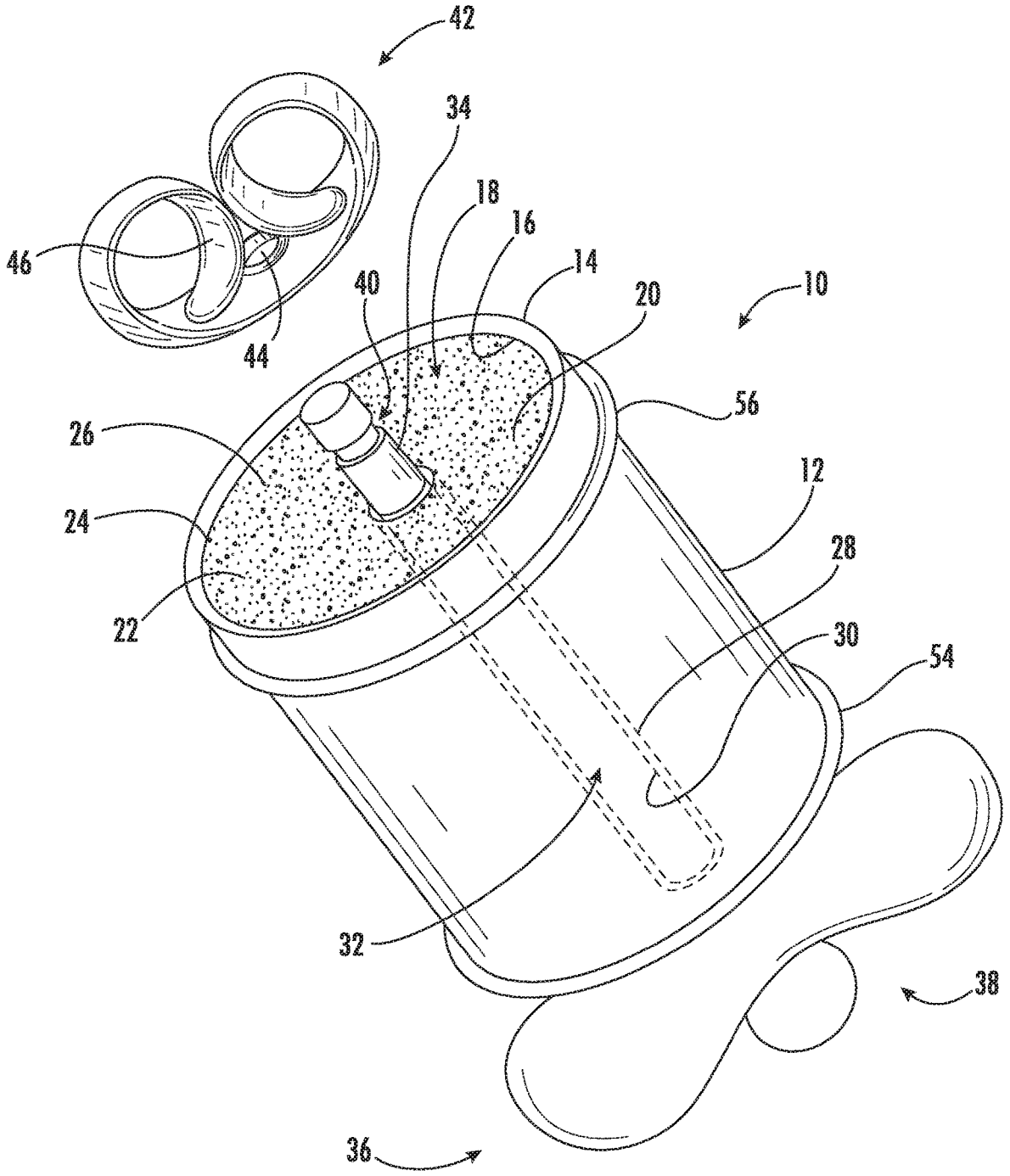
FIG. 1 illustrates side perspective view in partial phantom of the earring support system in accordance with one embodiment.

An earring support system of the present invention is shown generally as 10 in FIG. 1. The system 10 is provided with an outer sleeve 12, preferably constructed of stainless steel, or similar rigid material. The outer sleeve 12 defines an outer surface 14 and an inner surface 16. The outer surface 14 may be constructed of any suitable dimensions, but is preferably constructed with the same width and diameter as the width and diameter of the outer surface of a standard ear gauge tunnel, such as an eight gauge tunnel, such as those known in the art.

The inner surface 16 of the outer sleeve 12 defines an interior 18 of the outer sleeve 12. Provided in the interior 18 of the outer sleeve 12 is an inner sleeve 20. The inner sleeve 20 is cylindrical and constructed of a resilient material 22, such as silicone or rubber. In a preferred embodiment, the inner sleeve 20 is constructed by injecting liquid silicone into the interior 18 of the outer sleeve 12 and allowing an exterior surface 24 of the inner sleeve 20 to cure into engagement with the interior surface 16 of the outer sleeve 12. Alternately, the inner sleeve 20 may be formed from rubber and then secured into engagement with the interior surface 16 of the outer sleeve 12 with an adhesive such as those known in the art or simply by friction fit. If desired, the inner sleeve 20 may be colored and/or mixed with a material 26, such as glitter, prior to curing to provide additional aesthetics to the system 10.

As shown in FIG. 1, the inner sleeve 20 defines a passageway 28 having an interior surface 30 defining an interior 32. The interior surface 30 may be constructed of any suitable dimensions, but in the preferred embodiment is twenty gauge in diameter to accommodate all types of earring posts, including both eighteen gauge and twenty gauge pierced earring posts 34. As used in this specification, post is defined as any portion of a pierced earring designed to by secured through the interior of a user's ear. If a twenty gauge post 34 is to be used with a twenty gauge interior surface 30, it is desirable that the inner sleeve 20 be provided with an exterior surface 24 of a diameter slightly greater than the diameter of the inner surface 16 of the outer sleeve and friction fit therein, thereby slightly compressing entire inner sleeve 20 and twenty gauge interior surface 30, allowing the system 10 to hold the twenty gauge post 34 more securely.

If more securement is desired, or if smaller diameter posts 34 are to be secured, the interior surface 30 may be constructed with an interior dimension of twenty-two gauge or smaller.

Figure 2:
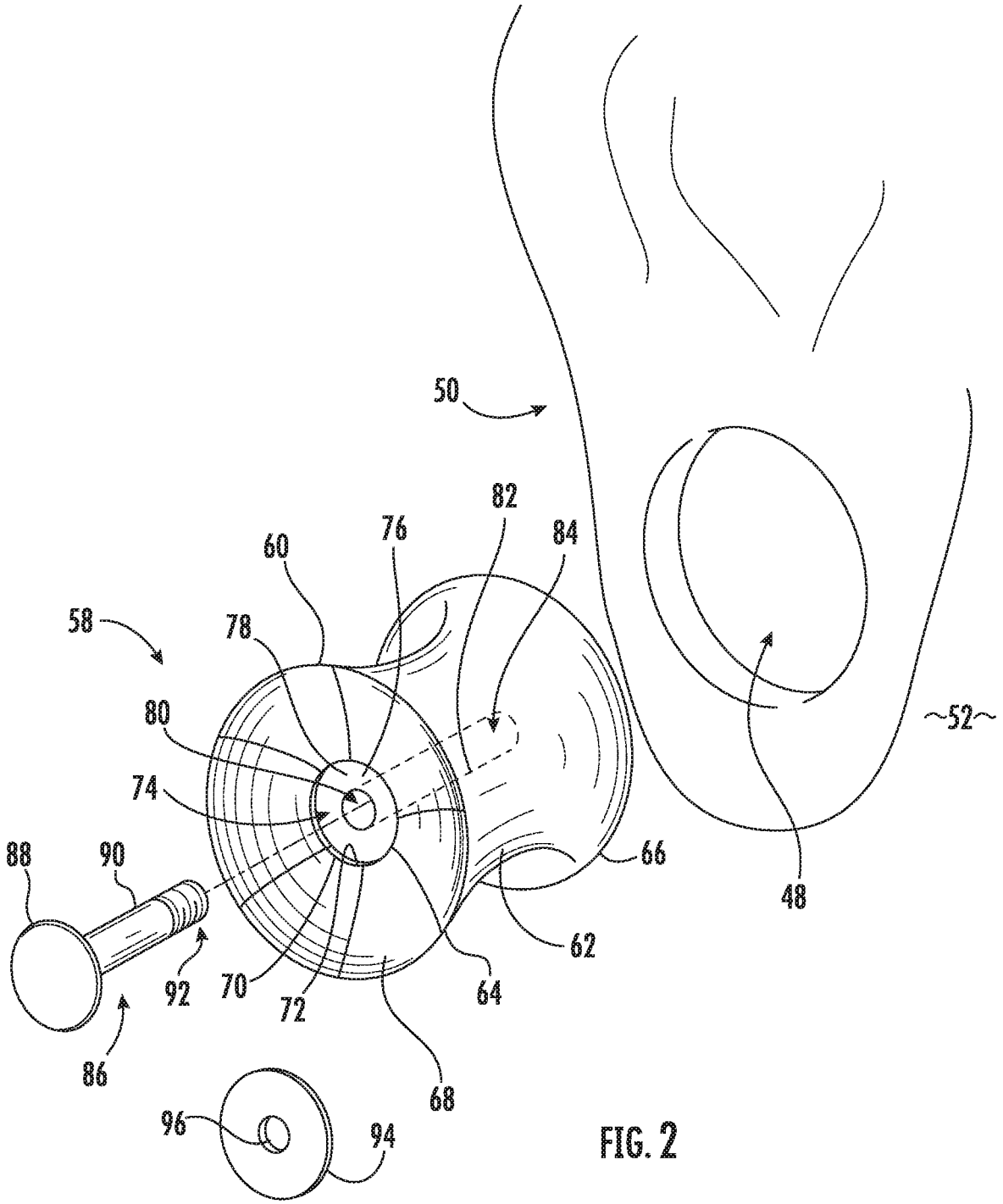
FIG. 2 illustrates an exploded view of the earring support system in partial phantom in accordance with one embodiment.

A pierced earring 36, such as those known in the art, is provided with an ornamental end 38 coupled to the post 34. The post 34 is provided with a catch, such as a detent 40, in a manner known in the art. The pierced earring 36 is also provided with a standard clutch 42 configured with a hole 44 to slide over the post 34 and keepers 46 engage the detent 40 in a known manner. When it is desired to use the system 10, the outer sleeve 12 is provided through an existing gauge hole 48 in an ear 50 of a user 52. (FIGS. 1-2). The outer sleeve 12 is integrally formed with a stainless steel flange 54 to engage the ear 50 of the user 52 and prevent the outer sleeve 12 from passing all of the way through the gauge hole 48. If desired, an O-ring 56 may be secured over the end of the outer sleeve 12 opposite the flange 54 in a manner known in the art to prevent the system 10 from becoming inadvertently dislodged from the gauge hole 48.

The post 34 of the earring 36 is pushed through the interior 32 of the passageway 28 until the ornamental end 38 contacts the inner sleeve 16. The post 34 is then pushed through the hole in the clutch 42 until the keepers 46 engage the detent 40. If it is desired to replace the earring 36, the process is reversed to remove the earring 36 and a new earring is inserted as described above. If it is desired to remove the system 10 from the ear 50, the O-ring 56 is rolled off of the outer sleeve 12 and the system 10 is removed from the ear 50 of the user 52. The system 10 may be removed from the ear 50 of the user 52 before or after removing the earring 36 from the passageway 28.

Alternatively, the inner sleeve 20 may be constructed thicker, with no passageway, requiring a pierced earring post 34 to be forced through the resilient material 22 to create a passageway 28 of a custom diameter, thereby allowing and so that the inner sleeve 20 to act as the keeper, pressing into direct engagement with the detent 40 of the earring 36 and securing the earring in place without the need for a separate clutch 42.

An alternative embodiment of the system is shown generally as 58 in FIG. 2. The system 58 is provided with an outer sleeve 60, preferably constructed of stainless steel, or similar rigid material. The outer sleeve 60 defines a concave outer surface 62 terminating in flanges 64 and 66 on either side. In the preferred embodiment, the flanges 64 and 66 are preferably provided with a similar diameter, in excess of fourteen gauge and at least one gauge greater diameter than the diameter of the concave outer surface 62. The outer sleeve 60 is provided with a plurality stainless steel spokes 68 secured to a hub 70 defining an inner surface 72. The outer sleeve 60 is preferably provided with three stainless steel spokes 68, but may be provided with any desired number of spokes 68.

The inner surface 72 of the hub 70 defines an interior 74 of the hub 70. Provided on the interior 74 of the hub 70 is an inner sleeve 76. The inner sleeve 76 is cylindrical and constructed of a resilient material 78, such as silicone or rubber in a manner such as that described above. As shown in FIG. 2, the inner sleeve 76 defines a passageway 80 having an interior surface 82 defining an interior 84.

A pierced earring 86, such as those known in the art, is provided with an ornamental end 88 coupled to a post 90. The post 90 is provided with a catch, such as a screw flight 92. The pierced earring 86 is also provided with a clutch 94 having a keeper, such as a threaded hole 96 configured to screw into threaded engagement with the with screw flight 92. When it is desired to use the system 58, the outer sleeve 60 is provided through an existing gauge hole 48 in the ear 50 of the user 52. Once inserted, the concave outer surface 62 of the outer sleeve 60 and the flanges 64 and 66 prevent the system 58 from becoming inadvertently dislodged from the gauge hole 48.

The post 90 of the earring 86 is pushed through the interior 84 of the passageway 80 until the ornamental end 88 contacts the inner sleeve 76. The threaded hole 96 of the clutch 94 is then screwed into engagement with the screw flight 92 of the post 90. If it is desired to replace the earring 86, the process is reversed to remove the earring 86 and a new earring is inserted as described above. If it is desired to remove the system 58 from the ear 50, the system 58 is simply removed from the ear 50 of the user 52.

Figure 3:
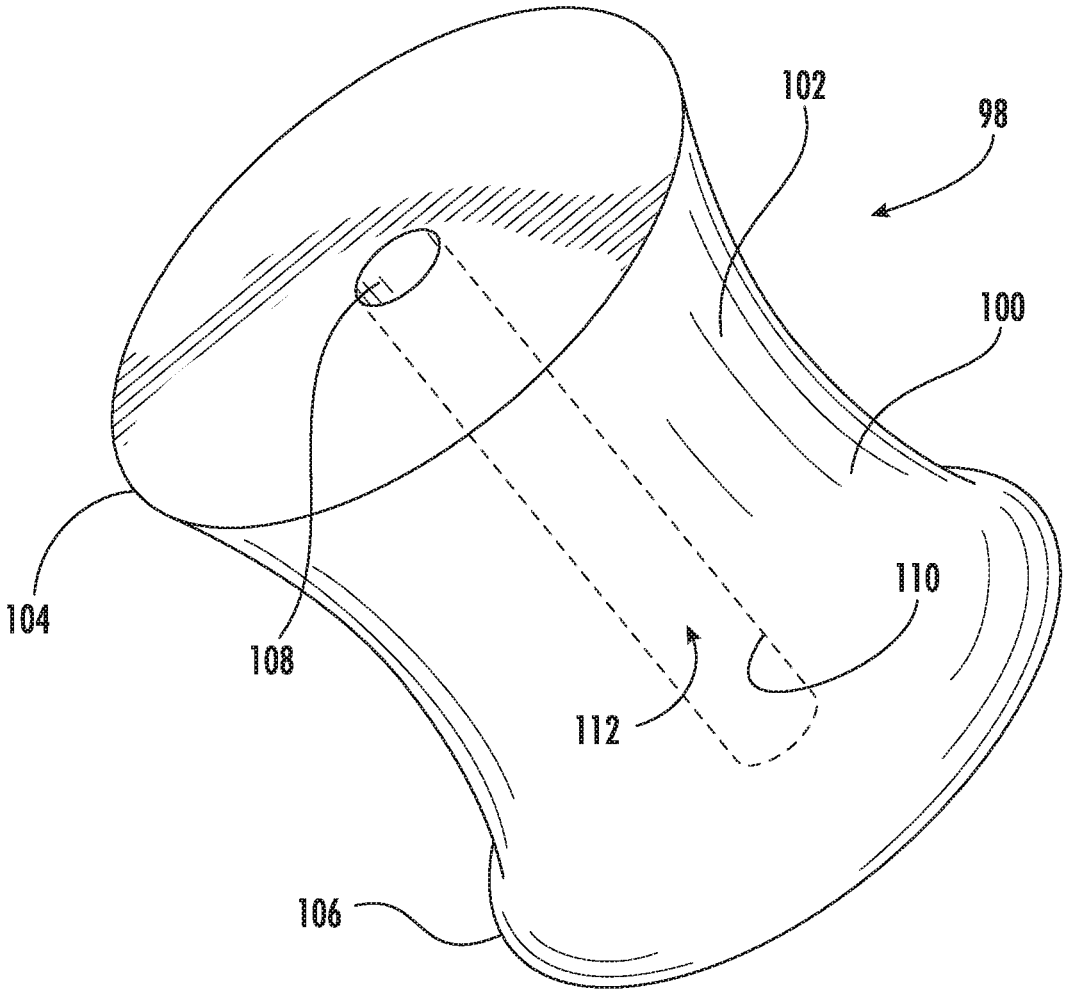
FIG. 3 illustrates a side perspective view in partial phantom of the body of the earring support system in accordance with one embodiment.

Another alternative embodiment of the system is shown generally as 98 in FIG. 3. The system 98 is molded out of silicone to form a one-piece resilient sleeve 100 formed with a concave outer surface 102 terminating in molded-in flanges 104 and 106 on either side. The sleeve 100 also defines a passageway 108 having an interior surface 110 defining an interior 112. The system 98 is used in a manner similar to that described above, with the sleeve 100 being inserted into the gauge hole 48 of the ear 50 of the user 52, and the post 90 of the pierced earring 86 being secured within the passageway 108 of the sleeve 100. (FIGS. 2-3). Alternatively, the sleeve 100 of FIG. 3 can be molded out of polyester casting resin to form a one-piece rigid sleeve 100. The one-piece rigid sleeve 100 can also be carved out of other materials, such as wood, bone, stone, metal, etc. In the event that the sleeve 100 of FIG. 3 is formed from a rigid material the passageway 108 may be enlarged to accommodate a silicone or other resilient sleeve therein to retain the post 90 of the pierced earring 86. The resilient sleeve may be glued or molded within the one-piece rigid sleeve 100. The resilient sleeve may be provided with its own passageway or made of a solid construction requiring the post 90 of the pierced earring 86 to pierce the resilient sleeve as the post 90 is pushed through the passageway 108 to retain the post 90 by the resilient friction of the resilient sleeve. In the event that the sleeve 100 of FIG. 3 is formed from a rigid material and no resilient sleeve is used to frictionally maintain the post 90 within the passageway 108, it is desirable to secure the clutch 42 over the end of the post 90 once the post has been interred through the passageway 108 to prevent the earring 36 from becoming inadvertently dislodged from the sleeve 100.

Figure 4:
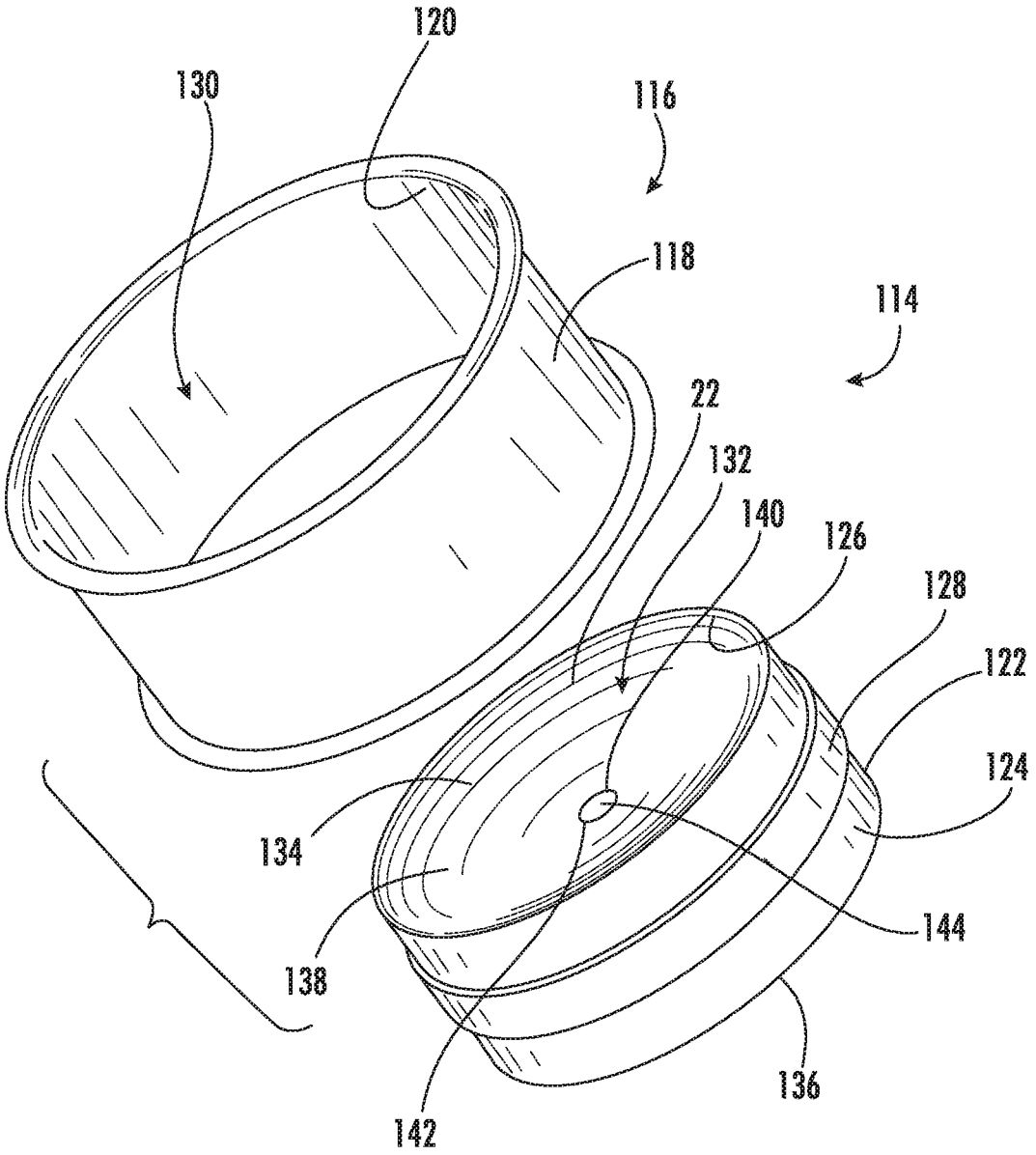
FIG. 4 illustrates an exploded view of the earring support system in accordance with one embodiment for use in association with existing gauges.

Another alternative embodiment of the system is shown generally as 114 in FIG. 4. This embodiment of the system 114 is for use in association with a prior art flanged ear gauge 116 defining an outer surface 118 and an inner surface 120. The system 114 provided with an outer sleeve 122, preferably constructed of stainless steel, or similar rigid material. The outer sleeve 122 similarly defines an outer surface 124 and an inner surface 126. The outer surface 124 of the outer sleeve 122 may be constructed of any suitable dimensions, but is preferably constructed with the same width and a slightly smaller diameter than the inner surface 120 of the ear gauge. Provided around the outer surface 124 of the outer sleeve 122 is a rubber band 128. The rubber band 128 is preferably thicker than the clearance between the inner surface 120 of the ear gauge 116 and the outer surface 124 of the outer sleeve 122 when the outer sleeve is positioned within an interior 130 defined by the inner surface 120 of the ear gauge 116. Rubber bands 128 or any desired thickness may be used to provide the desired amount of friction fit between the ear gauge 116 and the system 114, when the system 114 is pressed into the interior 130 defined by the inner surface 120 of the ear gauge 116. This embodiment of the system 114 allows the user to use prior art pierced earrings 86 with prior art gauges 116. (FIGS. 2 and 4).

The inner surface 126 of the outer sleeve 122 defines an interior 132 of the outer sleeve 122. Provided in the interior 132 of the outer sleeve 122 is an inner sleeve 134. The inner sleeve 134 is cylindrical and constructed of a resilient material 22, such as silicone or rubber. The ends 136 and 138 of the inner sleeve 134 are preferably concave, but may be flat or convex if desired. As shown in FIG. 4, the inner sleeve 134 defines a passageway 140 having an interior surface 142 defining an interior 144 in a manner such as that described above.

When it is desired to use the system 114, the rubber band 128 is provided around the outer surface 124 of the outer sleeve 122, and the system 114 is inserted into the ear gauge 116 whereafter the rubber band 128 frictionally secures the system 114 to the inner surface 120 of the ear gauge 116. Thereafter, the ear gauge 116 is inserted into the gauge hole 48 of the ear 50 of the user 52, and the pierced earring 86 is secured within the passageway 140 of the inner sleeve 134 in a manner such as that described above. (FIGS. 2 and 4). To remove the system 114, the process is simply reversed. Alternatively, the system 114 can be inserted and removed from the ear gauge 116 after the ear gauge 116 has already been secured with in the gauge hole of the ear 50.

Although the invention has been described with respect to a preferred embodiment thereof, it is to be understood that it is not to be so limited since changes and modifications can be made therein which are within the full, intended scope of this invention as defined by the appended claims.

What is claimed is:

1. An earring support device comprising:

a sleeve provided with a flange, an inner surface and an outer surface;

wherein at least a portion of a diameter of the inner surface is no greater than eighteen gauge;

wherein at least a portion of a diameter of the outer surface is no less than fourteen gauge;

wherein the inner surface is resilient and defines a passageway;

an earring comprising:

an ornamental end;

a catch;

a keeper provided into engagement with the catch;

a post securing the ornamental end to the keeper;

wherein the ornamental end of the earring is provided on a side of the sleeve;

wherein the post is provided at least partially within the passageway; and wherein the outer surface of the sleeve is secured into releasable engagement with an ear gauge.

2. The earring support device of claim 1, wherein the keeper is a clutch.

3. The earring support device of claim 1, wherein at least a portion of the diameter of the inner surface is no greater than twenty gauge.

4. The earring support device of claim 1, wherein at least a portion of the diameter of the outer surface is no less than twelve gauge.

5. The earring support device of claim 1, wherein the keeper is provided on a supplemental side of the sleeve.

6. The earring support device of claim 1, wherein the outer surface of the sleeve is secured into releasable engagement with a gauge hole of an ear.

7. An earring support device comprising:

a rigid outer sleeve provided with a flange, an inner surface, and an outer surface and defining an interior;

a resilient inner sleeve secured at least partially within the interior of the rigid outer sleeve and wherein at least a portion of the resilient inner sleeve is less rigid than at least a portion of the rigid outer sleeve;

wherein the resilient inner sleeve defines a passageway;

wherein at least a portion of a diameter of the passageway is no greater than eighteen gauge in diameter;

wherein at least a portion of a diameter of the rigid outer sleeve is no less than fourteen gauge;

an earring comprising:

an ornamental end;

a catch;

a keeper provided into engagement with the catch;

a post securing the ornamental end to the keeper;

wherein the ornamental end of the earring is provided on a side of the resilient inner sleeve; and wherein the post is provided at least partially within the passageway.

8. The earring support device of claim 7, wherein the keeper is a clutch.

9. The earring support device of claim 7, wherein at least a portion of the diameter of the resilient inner sleeve is no greater than twenty gauge.

10. The earring support device of claim 7, wherein at least a portion of the diameter of the rigid outer sleeve is no less than twelve gauge.

11. The earring support device of claim 7, wherein the keeper is provided on a supplemental side of the resilient inner sleeve.

12. The earring support device of claim 7, wherein the outer surface of the rigid outer sleeve is secured into releasable engagement with an ear gauge.

13. The earring support device of claim 7, wherein the outer surface of the rigid outer sleeve is secured into releasable engagement with a gauge hole of an ear.

* * * * *